US012264491B1

(12) United States Patent
Zeng

(10) Patent No.: US 12,264,491 B1
(45) Date of Patent: Apr. 1, 2025

(54) BEACH SUNSHADE CANOPY

(71) Applicant: Xianrui Zeng, Guangdong (CN)

(72) Inventor: Xianrui Zeng, Guangdong (CN)

( * ) Notice: Subject to any disclaimer, the term of this patent is extended or adjusted under 35 U.S.C. 154(b) by 0 days.

(21) Appl. No.: 18/828,411

(22) Filed: Sep. 9, 2024

(51) Int. Cl.
*E04H 15/34* (2006.01)
*E04H 12/22* (2006.01)
*E04H 15/64* (2006.01)

(52) U.S. Cl.
CPC ..... *E04H 15/34* (2013.01); *E04H 12/2223* (2013.01); *E04H 15/64* (2013.01)

(58) Field of Classification Search
CPC ..... E04H 15/64; E04H 15/34; E04H 12/2223
See application file for complete search history.

(56) References Cited

U.S. PATENT DOCUMENTS 2,211,283 A * 8/1940 Laughlin ..... E04H 12/2223 52/165
2,521,768 A * 9/1950 Adams ..... A45B 23/00 135/121
3,070,107 A * 12/1962 Beatty ..... E04H 15/003 D30/118
6,199,569 B1 * 3/2001 Gibson ..... E04H 12/2223 52/157
7,406,977 B1 * 8/2008 Shires ..... E04H 15/26 135/121
9,051,756 B1 * 6/2015 Jenkins ..... E04H 15/58
9,903,134 B2 * 2/2018 Munnerlyn ..... E04H 15/001
10,190,330 B2 * 1/2019 Barnes ..... E04H 15/003
10,602,817 B2 * 3/2020 Price ..... A45B 25/00
11,219,286 B2 * 1/2022 Cox ..... E04H 15/58
11,596,211 B2 * 3/2023 James ..... A45B 25/02
11,686,120 B1 * 6/2023 Yates ..... E04H 15/44 135/143
2023/0235592 A1 * 7/2023 Michel ..... E04H 15/28 135/115
2024/0044168 A1 * 2/2024 Zeng ..... E04H 15/44

* cited by examiner

*Primary Examiner* — Noah Chandler Hawk
(74) *Attorney, Agent, or Firm* — Jeenam Park

(57) ABSTRACT

This application relates to beach sunshades, particularly a beach sunshade canopy. It addresses prior issues where canopies were unstable in sand, prone to tilting, and difficult to secure and retract, resulting in a poor user experience. The solution includes a support pillar with a spiral fixing base at the bottom. A through hole on the side of the pillar contains a rotating shaft, to which an installation rod is fixed. The rod connects to a first arc-shaped plate at the bottom and a second arc-shaped plate at the top. Two opposing slots are provided at both ends of the through hole. This design ensures the canopy remains stable, preventing tilting and allowing for easy securing and retraction, enhancing the user experience.

4 Claims, 4 Drawing Sheets

BEACH SUNSHADE CANOPY

TECHNICAL FIELD

This application relates to the technical field of beach sunshades, specifically to a beach sunshade canopy.

BACKGROUND OF THE PRESENT INVENTION

Sunshades can block sunlight and heat from entering windows, offering superior shading effects and a fresh style. Outdoor sunshade systems can be categorized into various types such as sunshade canopies, tents, sun umbrellas, fixed canopies, modular ceiling canopies, aluminum modular tents, and carports. The sunshade canopy series can be further divided into retractable arm canopies, skylight canopies, and window canopies. Sunshades are widely used in practical applications, including on beaches, where they provide shade to enhance the overall experience.

However, existing beach sunshade canopies have certain drawbacks. They cannot be stably fixed in the sand during use, are prone to tilting, and are inconvenient to secure and retract, leading to a poor user experience.

SUMMARY OF PRESENT INVENTION

The objective of this invention is to address the shortcomings of existing technology, such as the inability to stably fix the sunshade canopy in the sand, the tendency to tilt, and the inconvenience of securing and retracting the sunshade, thereby improving the overall user experience.

This application provides a beach sunshade canopy using the following technical solution:

A Beach Sunshade Canopy, Comprising:

A support pillar;

A spiral fixing base, fixedly installed at the bottom of the support pillar. The support pillar has a through hole on its side, with a rotating shaft installed within the through hole. An installation rod is fixedly mounted on the rotating shaft, with a first arc-shaped plate fixedly installed at the bottom of the installation rod, and a second arc-shaped plate fixedly installed at the top of the installation rod.

Further Improvements:

The ends of the through hole are each equipped with two slots, which are oriented in opposite directions, and both slots match with the installation rod.

The top of the support pillar is equipped with a sliding hole, and a connecting rod is slidably installed within this hole. An installation frame is fixedly installed on the connecting rod, and a sunshade is provided on one side of the installation frame.

Both sides of the sunshade are equipped with Velcro, with the two pieces of Velcro wrapping around both sides of the installation frame. Multiple connecting straps are fixedly installed on one side of the sunshade.

One side of each connecting strap is fixedly connected to male buckles, while multiple female buckles are fixedly installed on one side of the installation frame. The male and female buckles are designed to fit together.

One side of the connecting rod is fixedly connected to a rope, with a sandbag attached to the other end of the rope.

In summary, this application includes at least the following beneficial technical effects:

1. The first and second arc-shaped plates can drive the installation rod to rotate, making it perpendicular to the support pillar. This rotation causes the spiral fixing base to drill into the sand. The sandbag can then be filled with an appropriate amount of sand and buried in the sand to secure the support pillar, preventing tilting during use.
2. The sunshade can be secured to the installation frame using Velcro on both sides and further fixed using the male and female buckles. After use, the sunshade can be quickly retracted by reversing the above steps.

Attachment markings: 1. Support Pillar; 2. Spiral Fixing Base; 3. Through Hole; 4. Rotating Shaft; 5. Installation Rod; 6. First Arc-Shaped Plate; 7. Second Arc-Shaped Plate; 8. Slot; 9. Connecting Rod; 10. Installation Frame; 11. Sunshade; 12. Velcro; 13. Connecting Strap; 14. Male Buckle; 15. Female Buckle; 16. Sandbag; 17. Connecting Rope.

DETAILED DESCRIPTION OF THE EMBODIMENT'S

The following is a clear and complete description of the technical solution in the embodiments of this invention, in conjunction with the accompanying drawings. It is evident that the described embodiments are merely part of the possible implementations of the invention and do not encompass all embodiments.

EMBODIMENT 1

Figure 1:
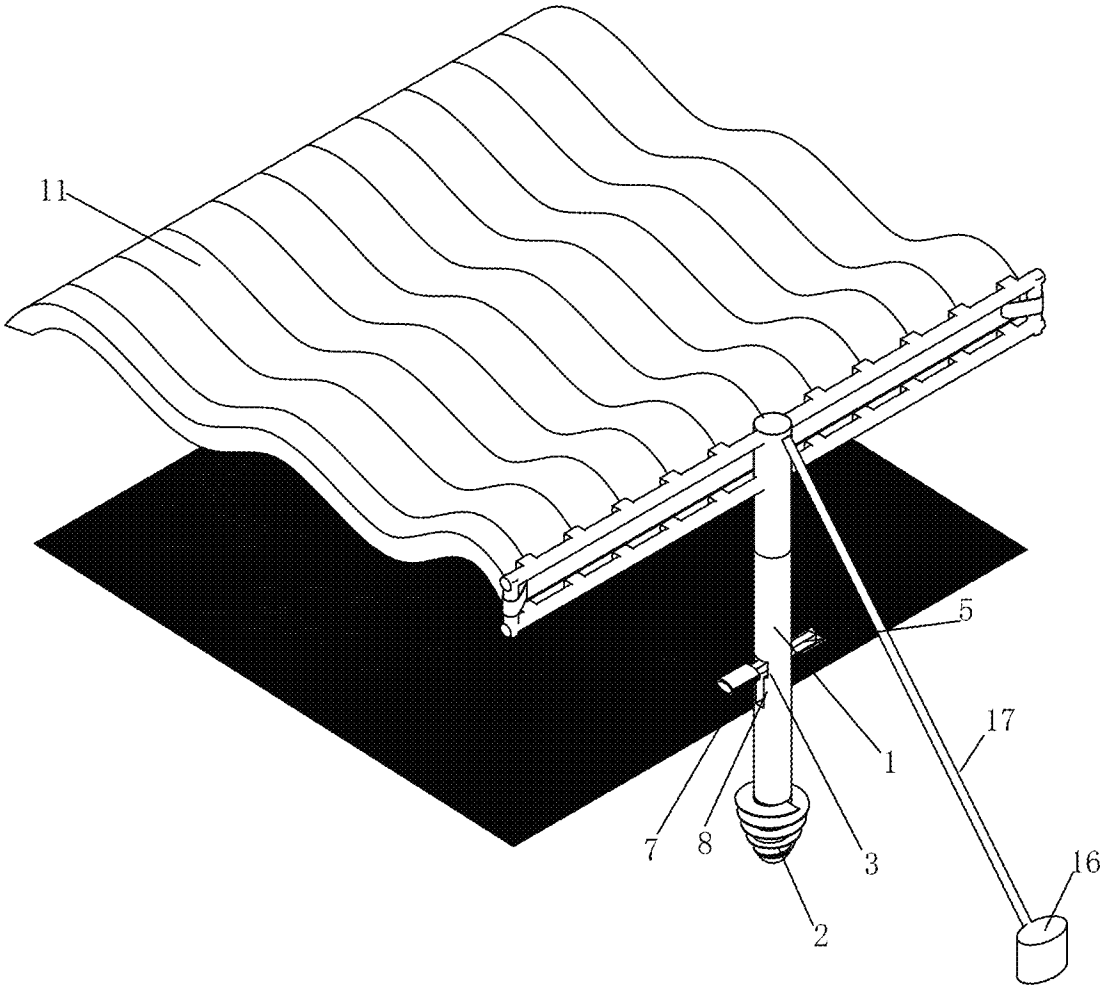
FIG. 1 is a left-side perspective view of the beach sunshade canopy in the first embodiment of this application.
Figure 2:
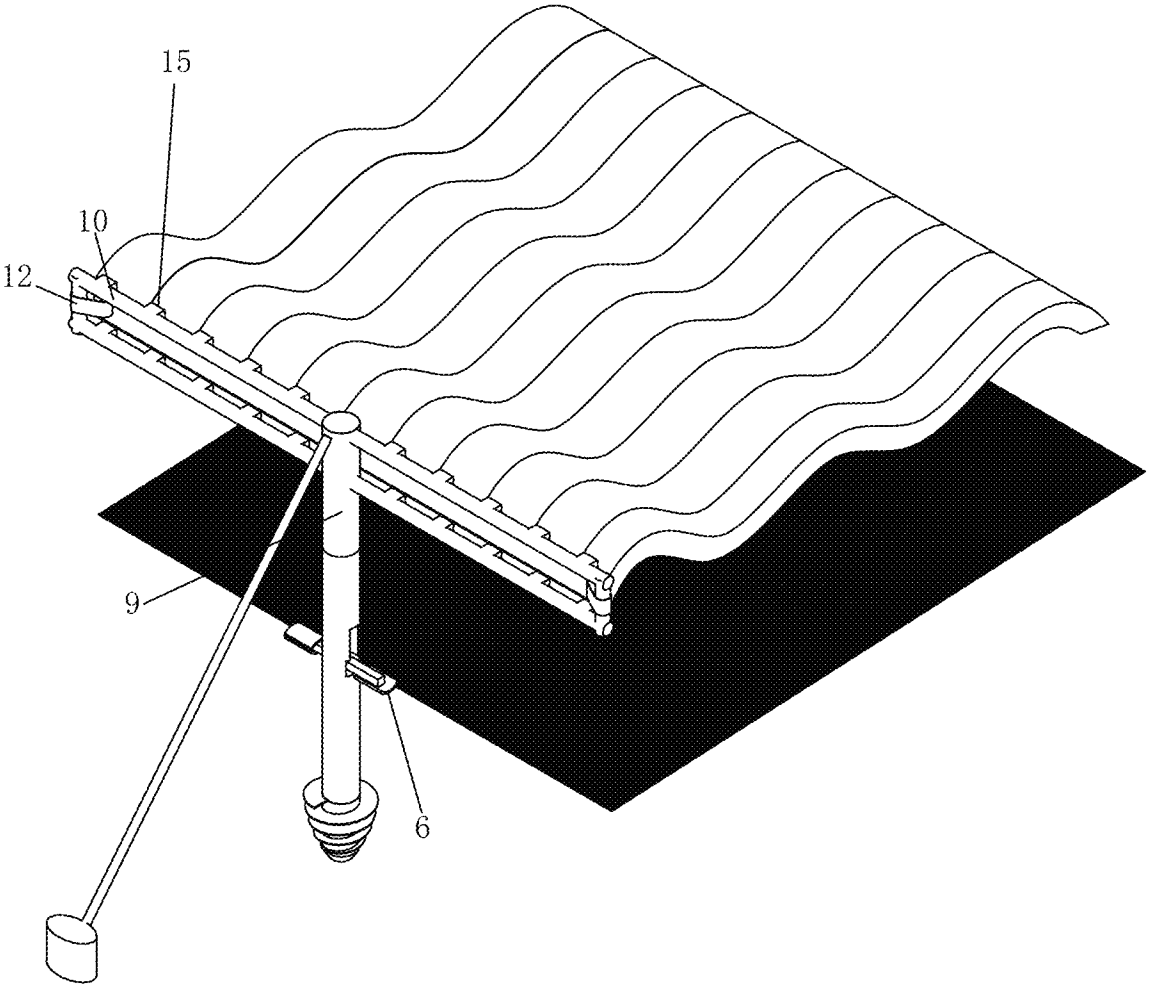
FIG. 2 is a right-side perspective view of the beach sunshade canopy in the first embodiment of this application.
Figure 3:
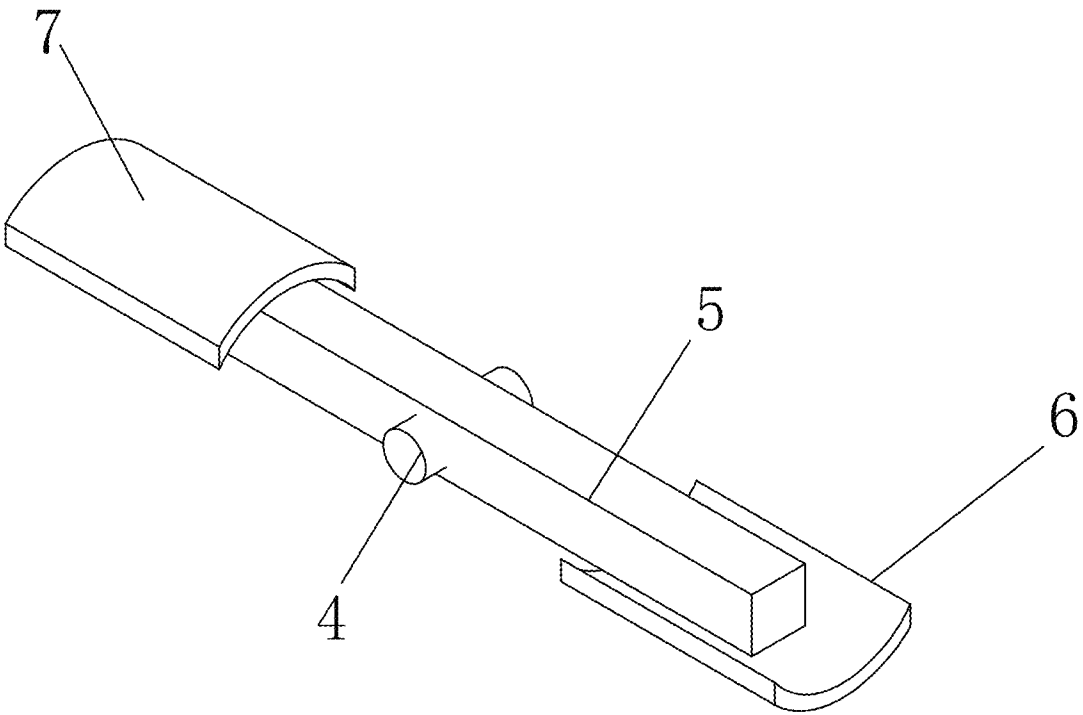
FIG. 3 is a perspective view of the fixing components of the beach sunshade canopy in the first embodiment of this application.
Figure 4:
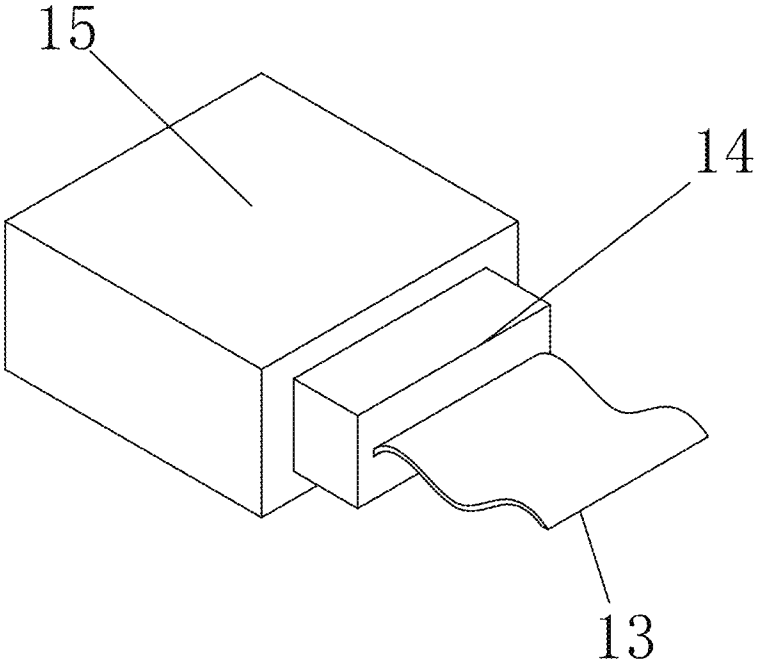
FIG. 4 is a perspective view of the installation components of the beach sunshade canopy in the first embodiment of this application.

Referencing FIGS. 1-4, a Beach Sunshade Canopy Includes:

A support pillar (1);

A spiral fixing base (2) fixedly installed at the bottom of the support pillar (1). The side of the support pillar (1) has a through hole (3), within which a rotating shaft (4) is rotatably installed. An installation rod (5) is fixedly mounted on the rotating shaft (4), with a first arc-shaped plate (6) fixedly installed at the bottom of the installation rod (5) and a second arc-shaped plate (7) fixedly installed at the top of the installation rod (5).

Specifically, both ends of the through hole (3) are equipped with two slots (8) oriented in opposite directions, which match with the installation rod (5).

Specifically, the top of the support pillar (1) has a sliding hole, within which a connecting rod (9) is slidably installed. An installation frame (10) is fixedly mounted on the connecting rod (9), and a sunshade (11) is provided on one side of the installation frame (10).

Specifically, both sides of the sunshade (11) are equipped with Velcro (12), which wraps around both sides of the installation frame (10). Multiple connecting straps (13) are fixedly mounted on one side of the sunshade (11).

Specifically, one side of each connecting strap (13) is fixedly connected to male buckles (14), while multiple female buckles (15) are fixedly installed on one side of the installation frame (10) to match with the male buckles (14).

Specifically, one side of the connecting rod (9) is fixedly mounted with a connecting rope (17), with a sandbag (16) attached to the other end of the rope (17).

The operational principle of the beach sunshade canopy in this embodiment is as follows: During use, the first arc-shaped plate (6) and the second arc-shaped plate (7) first drive the installation rod (5) to rotate, positioning it perpendicular to the support pillar (1). This rotation causes the support pillar (1) to turn, allowing the spiral fixing base (2) to drill into the sand. The sides of the sunshade (11) are fixedly connected to both sides of the installation frame (10) using Velcro (12). The multiple male buckles (14) are inserted into the multiple female buckles (15) to secure the sunshade (11). An appropriate amount of sand is then placed into the sandbag (16), which is buried in the sand. The connecting rod (9) is inserted into the sliding hole at the top of the support pillar (1). Under the influence of natural wind, air flows through the multiple ventilation holes located at one end of the sunshade (11) on the installation frame (10), causing the sunshade (11) to lift and provide shade. Once the use is complete, the above steps are reversed to quickly retract the sunshade (11) and the entire structure.

EMBODIMENT 2

The difference between this embodiment and Embodiment 1 is that both the first arc-shaped plate (6) and the second arc-shaped plate (7) are equipped with anti-slip layers to prevent slipping when securing the support pillar (1), even if the user's hands are wet.

The above descriptions represent the preferred embodiments of this application and are not intended to limit the scope of protection. Therefore, any equivalent changes made to the structure, shape, or principles described in this application should be included within the scope of protection of this application.

The invention claimed is:

1. A beach sunshade canopy, characterized by comprising:

a support pillar;

a spiral fixing base fixedly installed at a bottom of the support pillar, with a through hole provided on a side of the support pillar, and a rotating shaft rotatably installed within the through hole an installation rod is fixedly mounted on the rotating shaft, with a first arc-shaped plate fixedly installed at a bottom of the installation rod and a second arc-shaped plate fixedly installed at a top of the installation rod;

a sliding hole is provided at a top of the support pillar, a connecting rod is slidably installed within the sliding hole; an installation frame is fixedly installed on the connecting rod, a sunshade is provided on one side of the installation frame;

both sides of the sunshade are equipped with hook and loop fasteners, and two pieces of hook and loop fasteners respectively wrapping around both sides of the installation frame, a plurality of connecting straps are fixedly installed on one side of the sunshade.

2. The beach sunshade canopy according to claim 1, characterized in that: two slots are provided at both ends of the through hole, directions of the two slots are opposite to each other, and the two slots are matched with the installation rod.

3. The beach sunshade canopy according to claim 1, characterized in that: one side of each of the plurality of connecting straps is fixedly connected to male buckles, and a plurality of female buckles are fixedly installed on one side of the installation frame, and the plurality of male buckles are matched with the multiple-plurality of female buckles.

4. The beach sunshade canopy according to claim 3, characterized in that: one side of the connecting rod is fixedly mounted with a connecting rope, with one end of the connecting rope fixedly connected to a sandbag.

* * * * *